United States Patent [19]

Clarke

[11] 4,315,386

[45] Feb. 16, 1982

[54] PORTAL BUILDING STRUCTURES

[76] Inventor: Garry W. Clarke, 847 High Street Rd., Glen Waverley, Victoria, Australia

[21] Appl. No.: 103,517

[22] Filed: Dec. 13, 1979

[30] Foreign Application Priority Data

Dec. 13, 1978 [AU] Australia ..... PD7104

[51] Int. Cl.[3] ..... E04B 7/02; E04B 2/32

[52] U.S. Cl. ..... 52/93; 405/295

[58] Field of Search ..... 403/295; 52/93, 90, 52/639

[56] References Cited

U.S. PATENT DOCUMENTS

| | | | |
|---|---|---|---|
| 2,201,047 | 5/1940 | Moore | 52/729 |
| 2,989,154 | 6/1961 | Colby | 52/93 |
| 3,019,861 | 2/1962 | Rasch | 52/93 |
| 3,241,285 | 3/1966 | Baroni | 50/729 |
| 3,429,602 | 2/1969 | Dirilgen | 403/295 |
| 3,786,612 | 1/1974 | Baker | 52/639 |
| 3,802,134 | 4/1974 | McCorvey | 52/93 |

*Primary Examiner*—John E. Murtagh

*Attorney, Agent, or Firm*—Fleit & Jacobson

[57] ABSTRACT

A portal building frame formed of asymmetrical metal sections comprises a roof frame member supported on columns by means of knee connectors which telescopically engage with the roof frame member at each end thereof and with the columns. The connectors are secured to the roof frame member and the columns by bolts through both the webs of the metal sections and through flanges thereof, the bolts through the webs being longitudinally spaced by a distance corresponding to the lateral dimension of the webs. The knee connectors are each fabricated with reinforcing plates on the flanges of the metal sections at the joint between the sections forming the connector, and a stiffening plate is welded between mitred ends of the sections to the webs, flanges and reinforcing plates to form the one-piece connector. Secondary frame members are supported by the roof frame member with brackets fastened to the web of the roof frame member and to the secondary frame members so that the load transmitted by the brackets is through or close to the shear center of the metal section of the roof frame member.

16 Claims, 6 Drawing Figures

PORTAL BUILDING STRUCTURES

BACKGROUND OF THE INVENTION

This invention relates to improvements in framing structures for buildings and relates particularly to an improved portal frame structure—also knwon as "open" or "clear span" structures—for the construction of buildings or shelters.

Portal frames in buildings such as light industrial factories, warehouses, agricultural buildings and the like are presently fabricated from metal sections of both hot-rolled and cold-formed manufacture.

Hot rolled members, which are generally 'I' beams of various dimensions, are commonly used as framing members in portal buildings but their use requires substantial engineering design and fabrication detailing which results in a relatively expensive building construction. Further, because much of the fabrication is usually carried out in a welding shop and the components subsequently transported to the site for erection, difficulties are encountered in transporting the fabricated components.

Cold-formed sections have been used for the construction of relatively small buildings, such as domestic workshops, garages, farm sheds and the like, when the relatively thin walled sections are used well within their theoretical design capacity. Cold-formed sections used as primary members of a building frame are usually of lipped channel section or 'C' section which is asymmetrical and therefore loading on such members introduces significant secondary stressing which limits the member's structural capacity.

Further, in portal building frames, stresses are a maximum at the connections between the members, particularly the knee and ridge connections. Typical knee connections involve the use of end plates and cleats welded to the various members and subsequently bolted together. This connection system is similar to that used in connecting hot-rolled members.

Another connection system is disclosed in Australian Patent Application No. 25493/77 of Fletcher Industries Limited which discloses the use of a connector to and between adjacent portal members where the connector is attached, as by bolts, to the webs of the C-shaped portal members.

However, such connectors are located at the points of greatest stress in the frame and the bolted web connections introduce relatively large additional secondary stresses into the C-shaped portal members.

It is therefore desirable to provide a portal building framing system which uses single cold-formed metal sections as the framing structure and has connectors between the sections which increases the capacity and span of the sections heretofor acceptable.

It is also desirable to provide a portal building frame which is relatively simple to fabricate and transport to site for erection.

It is also desirable to provide a protal building framing system which enables secondary members, such as purlins and girts, to be secured to the primary portal members so as to give rise to a minimum of secondary stresses in the portal members.

It is also a desirable feature to provide a portal building framing system which uses standard sized portal members for a variety of sizes of buildings without the need to individually detail the design and fabrication of the portal members and connections.

SUMMARY OF THE INVENTION

In overcoming the problems of the prior art the present invention provides a portal building frame formed of cold-formed asymmetrical metal sections of substantially C-shaped cross-section, said frame comprising a pair of spaced, upright columns, a pair of knee connectors engaged with the upper ends of the columns and a roof frame member spanning between the knee connectors, the knee connectors being of cross-sectional dimensions to closely telescopically interfit the columns and the roof frame member, the columns, knee connectors and roof frame member being secured together with fasteners through engaging web surfaces and engaging flange surfaces of the components.

According to a preferred embodiment of the invention the portal building frame comprises a roof member supported at each end thereof by columns with knee connectors between the ends of the roof frame member and the columns, said roof frame member consisting of at least one cold-formed asymmetrical metal section having a web portion which lies substantially in the plane of the building frame, said knee connectors each consisting of a first part to engage an associated column and a second part to engage the end of the roof frame member, at least said second part being of cold-formed asymmetrical metal section of a cross-sectional shape corresponding to that of the roof frame member and of dimensions to closely telescopically interfit the roof frame member for a portion of the length of the second part and with reinforcing plates welded to flange portions of the second part, the roof frame member and the said second part being secured together by fasteners through the web portion and by additional fasteners through each of the flange portions.

The invention also provides a portal building framing system formed of cold-formed asymmetrical metal sections including a plurality of framing structures each having a roof frame member supported at each end by columns, the interconnection between the ends of the roof frame member for each frame structure and the associated column comprising a fabricated reinforced knee member telescopically engageable with the sections comprising the roof frame member and the column, said knee member having a first section of a shape and dimensions to closely telescopically engage with the metal section of the column, a second section of a shape and dimensions to closely telescopically engage with the metal section of the roof frame member, the first and second sections extending to a common plane angularly disposed with respect to said sections, reinforcing plates secured to faces of the first and second sections, and a stiffener member extending in said common plane and welded to the first and second sections and the reinforcing plates secured thereto.

In the system of this aspect of the invention, a desired number of framing structures are erected to constitute the framework of the building. A plurality of secondary members such as purlins and/or girts extend substantially at right angles to the framing structures and are secured thereto to support roofing and wall cladding material.

It is another feature of this invention that the purlins and/or girts are secured to the framing structure with brackets which are fixed to web portion of the metal sections forming the structure and fastened to purlin or girt at a location whereby the load on the metal sections passes through or adjacent the shear centre of the metal sections. This feature obviates secondary stresses which are otherwise developed with the asymmetrical sections are loaded directly through the plane of the web or through a top or bottom flange.

An embodiment of the invention will now be described with reference to the accompanying drawings.

DESCRIPTION OF THE PREFERRED EMBODIMENT

Figures 1, 2, 6:
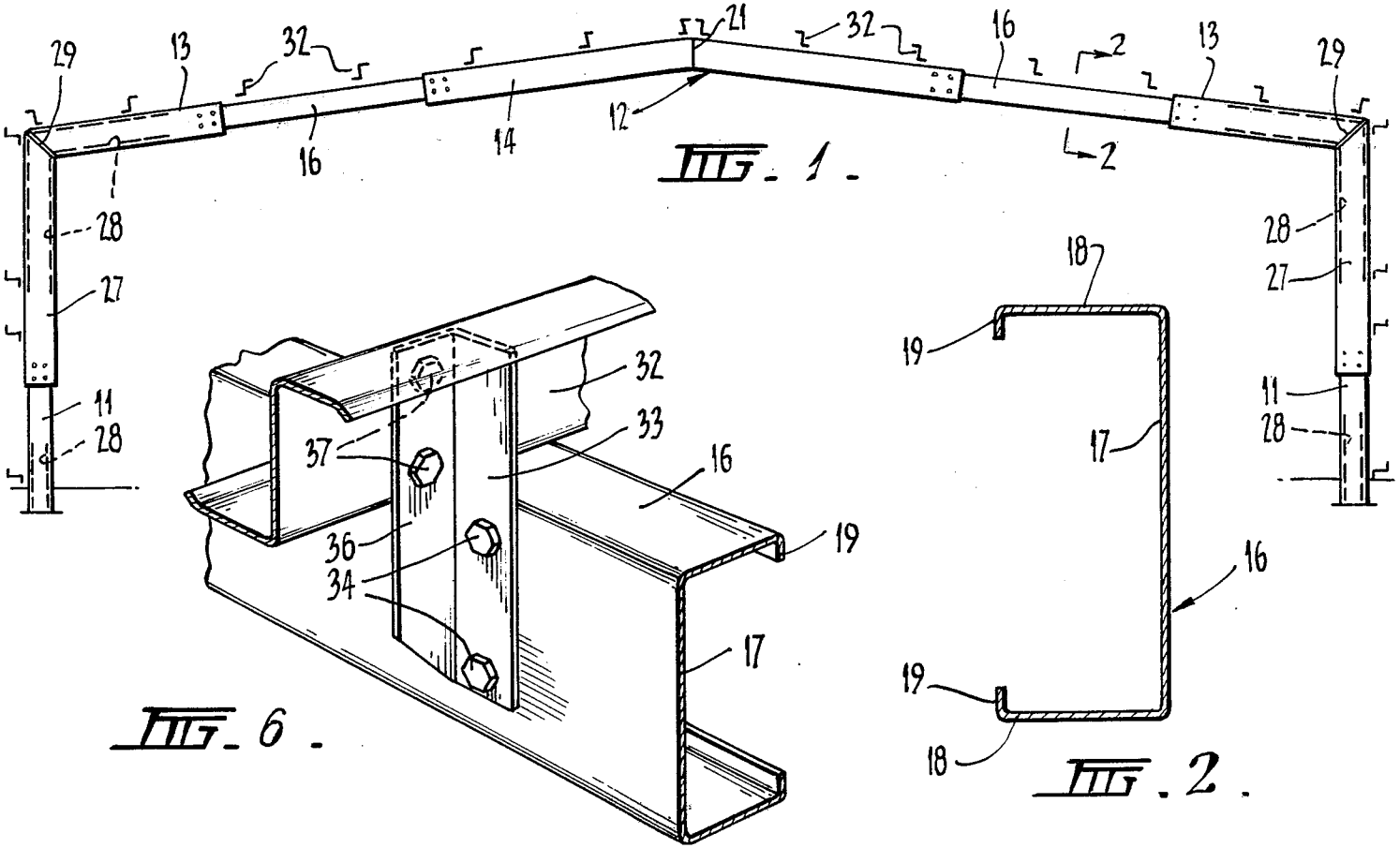
FIG. 1 is an elevational view of a portal building frame constructed in accordance with the present invention.
FIG. 2 is a cross-sectional view taken along the lines 2—2 of FIG. 1.
FIG. 6 is a detailed perspective view showing a bracket securing a purlin to a portal frame member.

Referring to the drawings FIG. 1 illustrates a typical portal frame structure comprising columns 11 and a roof support member 12 connected to the columns by means of knee connectors 13. The roof support member 12 consists of a ridge section 14 and two roof sections 16. The portal frame structure illustrated is a typical pitched portal configuration and is shown by way of example only. It will be appreciated that other configurations of portal building frame structures may be constructed in accordance with the features of the present invention.

All the components of the portal frame structure illustrated in FIG. 1 are constructed of cold-formed asymmetrical metal section of lipped channel or C-shaped cross section, as illustrated in FIG. 2. Such section comprises a web 17, which is positioned vertically in construction of the portal frame structure, flanges 18 and lips 19 extending towards each other from the flange edges.

The C-shaped sections comprising the knee connectors and the ridge section are of dimensions so as to closely telescopically receive the C-shaped sections of the roof sections 16 and the columns 11. It will therefore be seen that the height of the portal frame and the span between the columns are infinitely variable, within the load carrying capacity of the sections, simply by altering the length of the columns and the roof sections 16. The length of that part of each knee connector 13 engaging the appropriate roof section 16 may suitably be from 0.1 to 0.2 of the span distance, and the length of that part of the knee connector 13 engaging the column 11 may be of 0.4 to 0.7 of the overall wall height. Similarly, the length of the ridge section 14 may be 0.2 to 0.5 of the total span.

Figure 5:
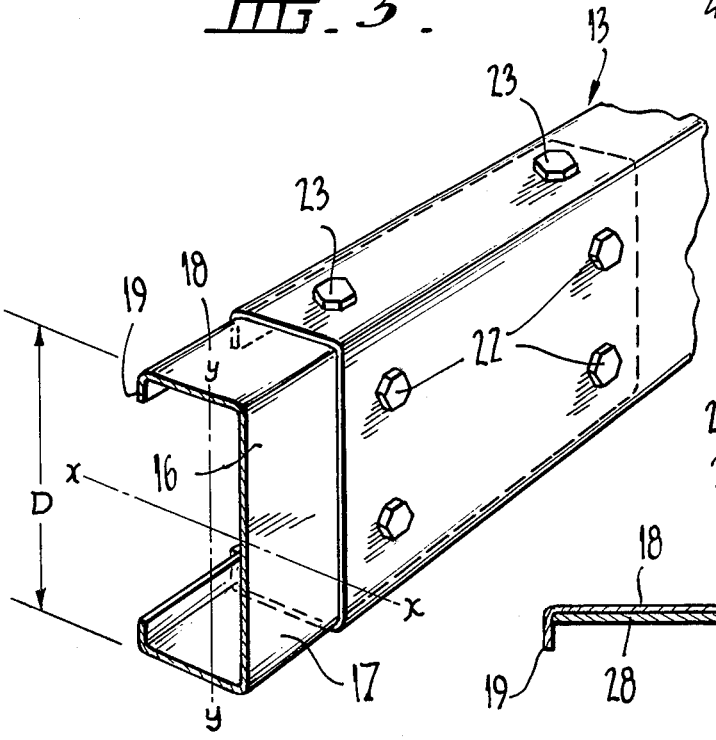
FIG. 5 is a detailed perspective view showing the fastening of a portal frame member to a knee connector.
Figure 5:
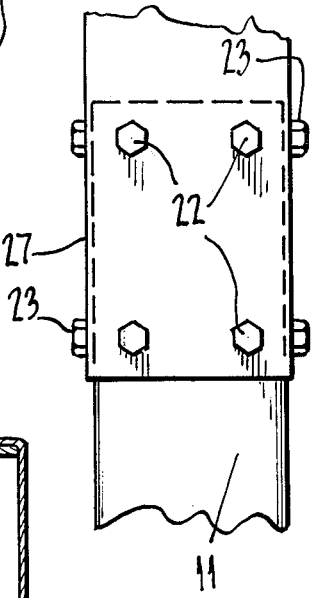

The telescopic engagement of the roof sections 16 in the knee connectors 13 and the ridge section 14 forms the basis for a joint arrangement which is more particularly illustrated in FIG. 5. The roof section 16 engages within the arm of the knee connector 13 a distance greater than the distance D which is the depth of the C-shaped section. Fasteners, such as bolts 22, pass through the engaging web surfaces of the members, and the fasteners are spaced apart in the longitudinal direction a distance which is approximately equal to the dimension D. Preferably, four bolts are engaged in the web portions of the members although two fasteners, spaced apart by the dimension D, may be used.

In addition to the web fasteners 22, flange fasteners 23 are provided in both the top and bottom flanges 18 of both overlapped members. The flange fasteners 23 are located in, or close to, the vertical centroidal plane passing through the C-shaped section (the plane indicated by the axis y—y in FIG. 5). This particular arrangement of fasteners securing the members together develops the full flexural and shear strength of the members joined, and the flange fasteners 23 lying in the vertical centroidal plane of the section do not induce secondary bending moments in the sections about the y—y axis. The spacing of the web blots 22 by the dimension D has been found to provide optimum resistance to secondary stressing in the form of torsion in the joined members while fully transmitting any given bending moment resulting from loading of the members.

As indicated above, in a portal frame structure of the type illustrated, the highest stressed areas are located at the fixed foundation level, i.e. the bottom of the columns 11, and the corners of the structure where the roof support member 12 engages with the columns 11, i.e. at the knee connections 13.

Figure 3:
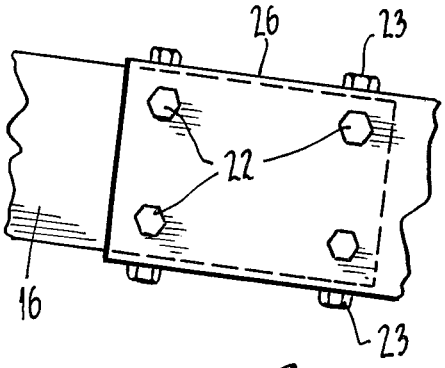
FIG. 3 is an enlarged view of a knee connector according to the invention.
Figure 3:
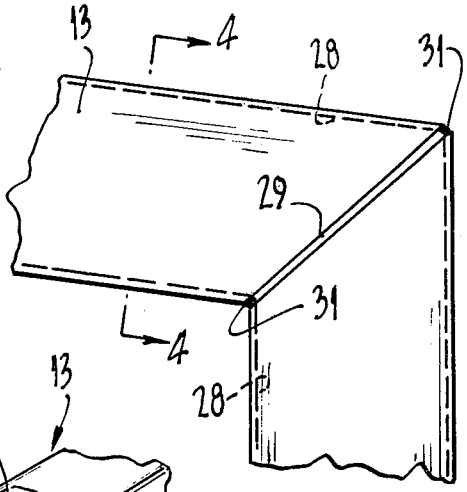
Figure 4:
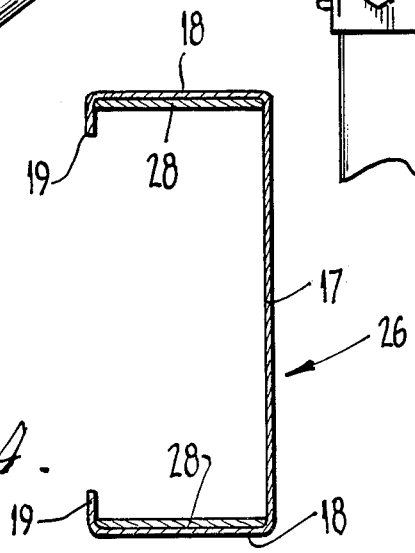
FIG. 4 is a cross-sectional view of the knee connector taken along the lines 4—4 of FIG. 3.

Referring particularly to FIGS. 3 and 4, each knee connector 13 of the illustrated embodiment is fabricated from two C-shaped sections which are welded together at an angle corresponding to the angle of the pitched configuration of the portal frame. The roof support leg 26 of the connector 13 has internal dimensions to closely receive the roof sections 16 in a telescopic engagement, as previously described and illustrated in FIG. 5 while the column engaging leg 27 of the knee connector 13 has internal dimensions to closely telescopically receive the C-shaped section forming the associated column 11. Both the roof support leg 26 and the column engaging leg 27 are provided with internal flange reinforcing plates 28 which are secured, as by welding, to the internal surface of the flanges 18 of the respective C-shaped sections. In construction of the knee connector 13, the two legs 26 and 27 of the connector and the flange reinforcing plates 28 in both legs are mitre cut at the desired angle. The cut faces of the legs 26 and 27 are brought together but spaced apart a distance to receive a stiffening plate 29 which extends transversely across the angled joint. The stiffening plate 29 is profile cut to fit neatly between the inside faces of the reinforcing plates 28, the inside faces of the webs 17 and flange lips 19 of the C-shaped sections forming both legs 26 and 27. Thus, a U-shaped cavity exists around the edges of the stiffening plate 29 which is filled with weld metal 31 in a full-strength but welded joint which securely welds the stiffening plate 29 to the reinforcing plates 28 as well as the webs 17, flanges 18 and lips 19 of the sections.

The flange reinforcing plates 28 may either be continuously welded or intermittently welded to the inside of the flanges 18 of both legs.

The base of each column 11 is similarly provided with flange reinforcing plates, similar to those of the knee connectors 13, as indicated in FIG. 1. The use of such reinforcing plates in the columns 11 ensures that the higher stress loadings at the column faces are adequately accommodated by the cold-formed C-shaped sections of the columns 11. It will be appreciated that the telescopic inter-engagement of the leg 27 with the column 11 is of the same arrangement as that illustrated in FIG. 5.

Portal building frames of the present invention are used as primary support members in a building structure. Secondary members, such as purlins and girts, span between the primary support members and support appropriate roofing material and wall cladding material of the building. Referring to FIG. 6 of the drawings, there is illustrated a bracket for securing a purlin (or girt) 32 to a roof section 16. When asymmetrical building members, such as the C-shaped roof section 16, are loaded in planes other than in the plane of the shear centre, torsional stresses as well as bending stresses are introduced into the section. The relatively thin walled C-shaped sections are weak in torsion and are therefore likely to distort under such loading. Therefore, the load carrying capacity of the section is correspondingly lessened.

The shear centre of a C-shaped section such as the roof section 16 is outside the extremeties of the section, 'behind' the mid height of the web. Therefore, loading of such a section on the top flange 18, which is the most obvious and direct loading location, always introduces secondary torsional stresses into the member.

The bracket 33 illustrated in FIG. 6 is designed to ensure that the roof section 16 is loaded substantially through the shear centre of the section. The bracket 33 is fastened to the web 17 of the roof section 16 with suitable fasteners, such as bolts 34. The bracket 33 has a leg 36 extending at right angles from the web 17, the leg 36 being provided with holes to receive further fastening bolts 37 which lie in a vertical plane passing through or close to the shear centre of the roof section 16. The purlin 32 is thus secured to the leg 36 with the fastening bolts 37.

The use of the bracket 33 therefore enables the roof section 16 to be loaded to close to its maximum carrying capacity without the need to be concerned about secondary torsional stresses introduced by direct loading to the flange. Further, the bracket 33 effects a flexurally stiff connection between the supported purlin 32, which is spaced from the top surface of the upper flange 18, and the roof section 16 which keeps the two joined members torsionally stable, each by virtue of the other member's flexural stiffness. It will also be appreciated that as the bracket 33 is bolted in position, preferably on site, the roof section 16 is free of projecting cleats or other fastening means thus enabling more efficient transportation of a plurality of such roof sections 16.

The portal building frame structure of the present invention enables relatively quick and simple construction of the various component parts, in modular units, for a wide variety of building dimensions. Thus, the knee connectors 13 and ridge sections 14 may be formed of a standard, C-shaped section, and is usable with roof sections 16 and columns 11 of varying lengths to form portal building framework of a variety of sizes. Disclosure and drawings contained herein are intended as illustrative of the invention and not delimiting of its scope; therefore, all those modifications and extensions of the invention which are obvious to one of ordinary skill in the art are considered to come within the scope and ambit of the specification.

I claim:

1. A portal building frame comprising a pair of spaced substantially C-shaped cross-sectioned, upright columns, a pair of knee connectors engaged with upper ends of the columns and a substantially C-shaped roof frame member spanning between the knee connectors, the knee connectors each having a column engaging leg and a roof support leg, both legs being of substantially C-shaped cross-section and being of dimensions to closely telescopically interfit the respective column and roof frame member with the web portions of the sections lying in a substantially vertical plane, each of the legs of each knee connector being mitre cut at an angle whereby the roof support leg extends at the desired roof pitch angle when the mitred cut ends are interengaged, and a stiffening plate disposed between the mitred cut ends of both legs and welded to the web portion and flange portions of both legs, the columns, knee connectors and roof frame member being secured together with fasteners through engaging webs and engaging flanges of the components.

2. A frame according to claim 1 wherein the fasteners through the engaged webs are spaced apart in the longitudinal direction of the members a distance substantially equal to the lateral dimension of the webs.

3. A frame according to claim 1 wherein said roof frame member comprises a ridge section closely telescopically engaged with two roof sections whereby the roof sections and ridge section constitute a pitched portal configuration.

4. A frame according to claim 1 wherein each of said legs of each knee connector has reinforcing plates welded to the flange portions of the sections and the stiffening plate is additionally welded to the reinforcing plates.

5. A frame according to claim 4 wherein additional reinforcing plates are welded to the flanges of the sections of the columns at the bases thereof.

6. A portal building frame formed of cold-formed asymmetrical metal sections of substantially C-shaped cross-section, said frame comprising a pair of spaced, upright columns, a pair of knee connectors engaged with the upper ends of the columns and a roof frame member spanning between the knee connectors, the knee connectors being of cross-sectional dimensions to closely telescopically interfit the columns and the roof frame member, the columns, knee connectors and roof frame member being secured together with fasteners through engaging webs and engaging flanges of the components, each said knee connector having a roof support leg and a column engaging leg, each of said legs having reinforcing plates welded to the flanges of the sections, both legs and associated reinforcing plates being mitre cut at an angle whereby the roof support leg extends at the desired roof pitch angle when the mitred cut ends are interengaged, and a stiffening plate disposed between the mitred cut ends of both legs and welded to the webs, flanges and reinforcing plates of both legs.

7. A frame according to claim 6 wherein additional reinforcing plates are welded to the flanges of the sections of the columns at the bases thereof.

8. A portal building frame comprising a roof frame member supported at each end by columns with knee connectors between the ends of the roof frame member and the columns, said roof frame member consisting of at least one cold-formed asymmetrical metal section having a web which lies substantially in the plane of the building frame and depending flange portions, said knee connectors each consisting of a first part to engage as associated column and a second part to engage the end of the roof frame member, at least said second part being of cold-formed asymmetrical metal section of a cross-sectional shape corresponding to that of the roof frame member and of dimensions to closely telescopically interfit the roof frame member for a portion of the length of the second part and with reinforcing plates welded to flange portions of the second part, the roof frame member and the said second part being secured together by fasteners through the web portion and by additional fasteners through each of the flange portions.

9. A frame according to claim 8 wherein the roof frame member, the first and second parts of both knee connectors and both columns are formed of lipped channel metal sections, and reinforcing plates are welded to the inner surfaces of the flanges of the first and second parts of each knee connector at least adjacent the joint between said first and second parts, and further reinforcing plates are welded to the flanges of both columns adjacent the bases thereof.

10. A frame according to claim 8 wherein the fasteners through the engaged webs of the second knee connector part and the roof frame member are spaced apart in the longitudinal direction of the members a distance substantially equal to the lateral dimensions of the webs.

11. A frame according to claim 9 wherein a stiffening plate is welded to the webs, flange portions and reinforcing plates of both first and second knee connector parts at the joint therebetween.

12. A frame according to claim 8 wherein a plurality of secondary frame members are secured to and carried by the roof frame member with brackets fastened to the web of the roof frame member, said secondary frame members being fixed to said brackets by fastening means located so that the line of the load supported by each bracket is in or close to a vertical plane parallel to the axis of the metal section passing through the shear centre of the section.

13. A portal building framing system formed of cold-formed asymmetrical metal sections including a plurality of framing structures each having a roof frame member supported at each end by columns, the interconnection between the ends of the roof frame member for each frame structure and the associated column comprising a fabricated reinforced knee member telescopically engageable with the sections comprising the roof frame member and the column, said knee member having a first section of a shape and dimensions to closely telescopically engage with the metal section of the column, a second section of a shape and dimensions to closely telescopically engage with the metal section of the roof frame member, the first and second sections extending to a common plane angularly disposed with respect to said sections, reinforcing plates secured to faces of the first and second sections, and a stiffener member extending in said common plane and welded to the first and second sections and the reinforcing plates secured thereto.

14. A system according to claim 13 wherein said asymmetrical sections comprise lipped channel sections wherein the base of the channel constitutes a web which extends in a substantially vertical plane and upper and lower flanges with depending lips extend therefrom, and wherein the telescopically engaged sections are secured together with fasteners which pass through the engaged webs and flanges, the fasteners through the engaged webs being spaced apart in the longitudinal direction of the sections a distance substantially equal to the lateral dimensions of the webs.

15. A system according to claim 13 wherein a plurality of secondary frame members are secured to and carried by the roof frame member with brackets fastened to the web of the roof frame member, said secondary frame members being fixed to said brackets by fastening means located so that the line of the load supported by each bracket is in or close to a vertical plane parallel to the axis of the metal section passing through the shear centre of the section.

16. A frame according to claim 13, wherein said reinforcing plates are welded to the flange portions of the sections, such that an entire face of each reinforcing plate mates with a face of the flange portion to which it is welded.

* * * * *